United States Patent [19]

Schmidt et al.

[11] Patent Number: 5,071,107

[45] Date of Patent: Dec. 10, 1991

[54] METALLURGICAL TUNDISH WITH FILTER

[75] Inventors: Manfred Schmidt, Bethlehem; John Blackwood, Jr., Center Valley, both of Pa.

[73] Assignee: Bethlehem Steel Corporation, Bethlehem, Pa.

[21] Appl. No.: 616,494

[22] Filed: Nov. 21, 1990

[51] Int. Cl.[5] ..... B22D 41/00

[52] U.S. Cl. ..... 266/230; 266/229; 266/275

[58] Field of Search ..... 266/230, 229, 227, 275, 266/236; 222/591, 590, 597, 594

[56] References Cited

U.S. PATENT DOCUMENTS

| | | | |
|---|---|---|---|
| 2,757,425 | 8/1956 | Duncan et al. | 22/57.2 |
| 3,006,473 | 10/1961 | Gamber | 210/69 |
| 3,111,732 | 11/1963 | Schroer et al. | 22/209 |
| 3,305,351 | 2/1967 | Bylund | 75/68 |
| 3,524,548 | 8/1970 | McDonald et al. | 210/153 |
| 3,537,987 | 11/1970 | Copeland | 210/20 |
| 3,654,150 | 4/1972 | Eccles | 210/69 |
| 4,277,281 | 7/1981 | Weber et al. | 75/93 |
| 4,368,834 | 1/1983 | Daussan et al. | 222/597 |
| 4,671,499 | 6/1987 | Ishiyama et al. | 266/275 |
| 4,776,570 | 10/1988 | Vo Thanh et al. | 266/229 |
| 4,789,140 | 12/1988 | Lirones | 266/238 |
| 4,968,007 | 11/1990 | Forte et al. | 266/230 |

*Primary Examiner*—S. Kastler, III

[57] ABSTRACT

Disclosed is a tundish apparatus for holding and filtering molten metal, such as steel, prior to the molten metal being continuously cast. An enclosure around the discharge orifice of the tundish accommodates a ceramic filter medium. The enclosure has a removable cover plate to allow continuous discharge of the molten metal in the event the filter medium becomes clogged and to allow access to the tundish nozzle.

2 Claims, 1 Drawing Sheet

METALLURGICAL TUNDISH WITH FILTER

BACKGROUND OF THE INVENTION

This invention relates to the continuous casting of molten metal. It relates particularly to the construction of a tundish used to control the flow and improve the quality of the molten metal before it is cast.

In the continuous casting of molten metal, such as steel, the molten metal is brought to the casting machine in a bottom pour ladle and is poured into a refractory lined tundish positioned over the mold in the continuous casting machine. The tundish serves as a reservoir of molten metal at constant head and also allows most of the impurities in the molten metal to float out of the metal before it is cast. Some tundishes use special slags and baffles to assist in the removal of the impurities. In the case of steel, aluminum oxide is an undesirable impurity since it will cause serious inclusions in the cast steel but aluminum oxide particles have been difficult to remove.

Metal producers have tried to use ceramic filters in the tundish in an attempt to filter out the impurities. While such filters have been somewhat successful with low temperature melting pint metals, such as aluminum, zinc and lead, they have not proven successful with high temperature molten steel. Such filters have tended to clog with tundish slag and restricted the uniform flow of the molten steel from the tundish to the continuous casting mold.

SUMMARY OF THE INVENTION

It is an object of this invention to provide a tundish that will remove impurities from the molten metal before it is cast.

It is a further object of this invention to provide a tundish that is able to filter out impurities from the molten metal without reducing the flow rate of the molten metal being discharged from the tundish.

It is still further object of this invention to provide a tundish which will produce a molten metal suitable for continuous casting with a minimum amount of inclusions.

It has been discovered that the foregoing objectives can be attained by an elongated tundish for containing molten metal and having a molten metal entry at one end and a molten metal discharge orifice in the bottom of the other end, and an enclosure around the discharge orifice. The enclosure contains a filter medium and has a removable cover plate on top of the enclosure.

DESCRIPTION OF THE PREFERRED EMBODIMENT

Figure 1:
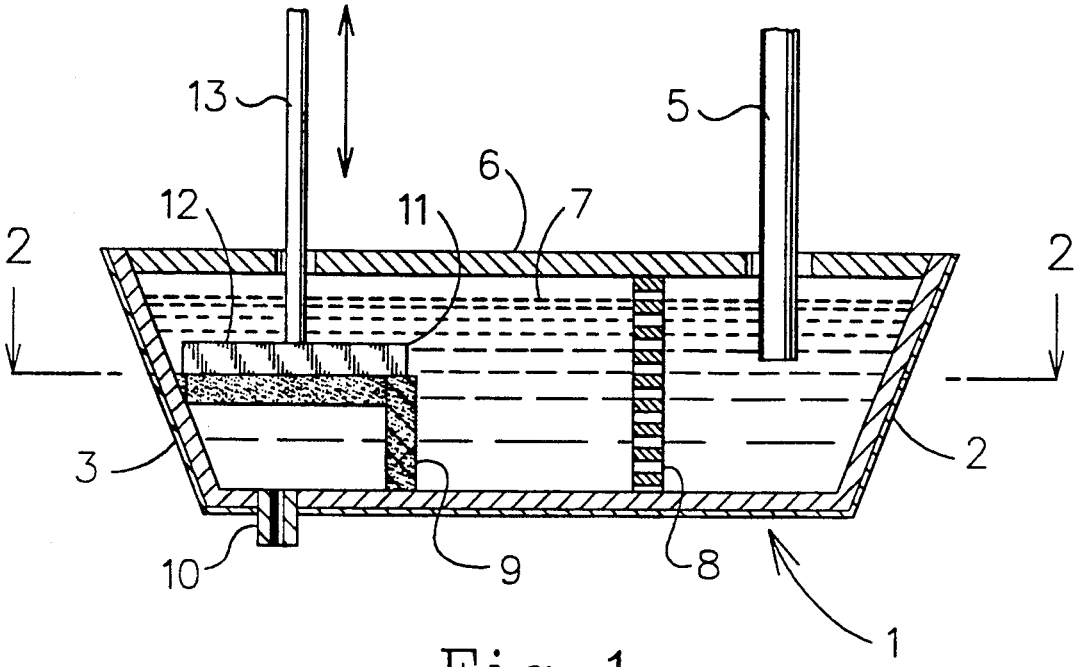
FIG. 1 is a longitudinal elevational sectional view of a tundish of the present invention.
Figure 2:
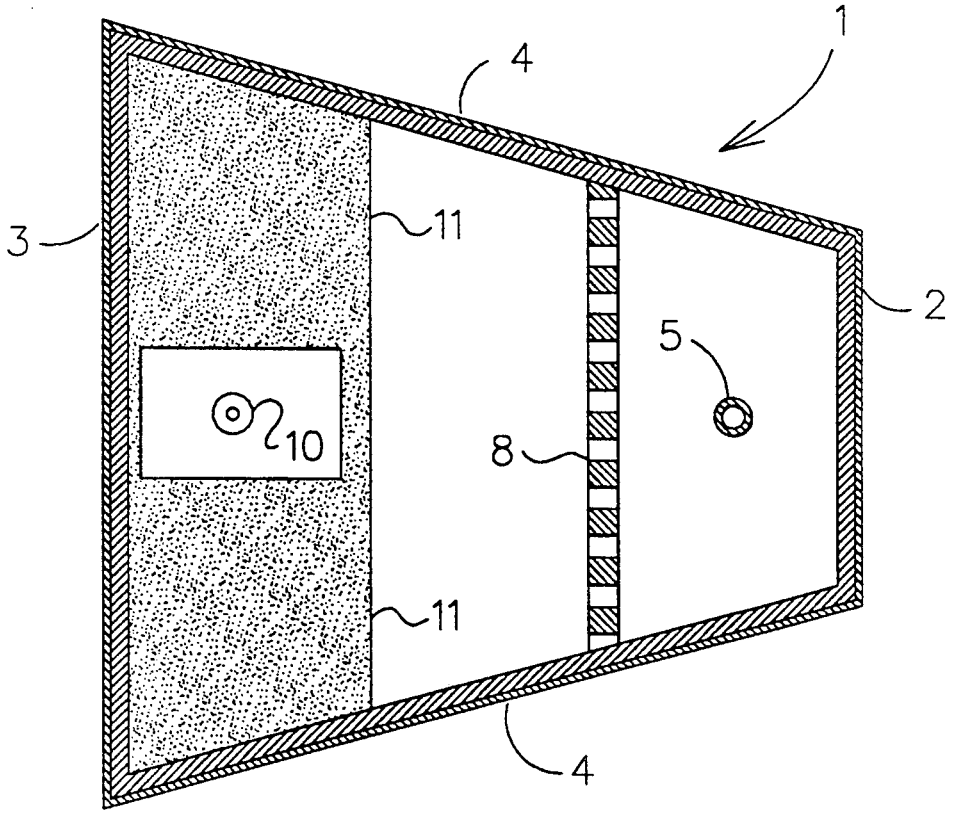
FIG. 2 is a top view of the tundish of the present invention.

FIGS. 1 and 2 illustrate a preferred embodiment of the molten metal tundish of this invention. Tundish 1 comprises a four sided refractory lined vessel with a removable cover 6. The tundish 1 has a sloping entry end wall 2, a sloping discharge end wall 3 and a pair of sloping sidewalls 4. In this embodiment the sidewalls 4 are spaced farther apart at the discharge end than at the entry end of the tundish but could be parallel to each other if desired.

A ladle (not shown) positioned above the tundish 1 supplies molten metal to the tundish 1 through a submerged refractory tube 5. The level of the molten metal, shown by line 7, is maintained substantially constant. The molten metal flows slowly from the entry end of the tundish through a perforated refractory baffle 8 towards the discharge end. Baffle 8 is designed to produce a uniform flow of molten metal from the entry and to the discharge end of the tundish with a minimum amount of turbulence or eddies.

An enclosure 9 is built around the discharge orifice 10 of the tundish and extends across the tundish 1 as shown in FIG. 2. The walls of the enclosure 9 contain panels 11 of a ceramic filter medium capable of withstanding high temperatures. The filters 11 are designed to trap and filter out any solid impurities in the molten metal. As shown in FIG. 1, this embodiment uses the sloping discharge end wall 3 to form a portion of the filter enclosure 9 around the discharge orifice 10. In the event the filters 11 become clogged with impurities causing the flow of molten metal from the discharge orifice 10 to decrease, the enclosure 9 is provided with a removable refractory cover plate 12 attached to a vertical rod 13 which can be lifted allowing a portion of the molten metal to flow directly to the discharge orifice to maintain a uniform rate of discharge until the end of the cast. The cover plate 12 on enclosure 9 has several other important benefits. During the initial filling of the tundish 1 with molten metal, the steel should contact the discharge orifice or nozzle 10 with a "hard" impact during the start-up. A completely closed filter would not permit such a "hard" opening and therefore the cover plate 12 is raised during the initial filling of the tundish, to allow much of the molten steel to by-pass the filter and thus have a "hard" opening. The cover plate 12 is then lowered as the casting progresses.

The cover plate 12 also permits one to selectively filter only those grades of steel where cleanliness of the steel is a problem. For example, the cover plate 12 would be closed when inclusion sensitive grades are cast in a continuous sequence and then opened when less sensitive grades are being cast.

The cover plate 12 is also useful at the end of a cast to prevent the entry of slag floating on the surface of the steel from entering the discharge orifice or nozzle 10. Closing the cover plate 12 prevents the entry of any slag into the nozzle 10.

The large enclosure 9 provides a large surface area for filter panels 11 as compared to some metal filters that have a small filter surface area. The larger the surface area the longer the filter will function without clogging.

Although one embodiment of the present invention has been illustrated and described, it will be apparent to those skilled in this art that various changes and modifications may be made without departing from the spirit of this invention.

I claim:

1. An elongated tundish for containing molten metal having a pair of sidewalls and a pair of end walls and having a molten metal entry at one end and a molten metal discharge orifice in the bottom of the other end and one or more refractory baffle members spaced between said molten metal entry and said molten metal discharge orifice, an enclosure around said discharge orifice containing a ceramic filter medium and a removable cover on top of said enclosure said enclosure extending between said sidewalls and one end wall, the top of said enclosure being positioned about half the height of said sidewalls below the level of molten metal in said tundish.

2. The tundish of claim 1 in which a vertical rod is attached to said removable cover.

* * * * *